US008016048B2

(12) United States Patent
Ueda et al.

(10) Patent No.: US 8,016,048 B2
(45) Date of Patent: Sep. 13, 2011

(54) ELECTRICAL POWER TOOL

(75) Inventors: Takashi Ueda, Hitachinaka (JP); Takao Aradachi, Hitachinaka (JP); Junichi Toukairin, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 181 days.

(21) Appl. No.: 12/530,619

(22) PCT Filed: Apr. 23, 2008

(86) PCT No.: PCT/JP2008/058294

§ 371 (c)(1),
(2), (4) Date: Sep. 9, 2009

(87) PCT Pub. No.: WO2008/133339

PCT Pub. Date: Nov. 6, 2008

(65) Prior Publication Data

US 2010/0038103 A1 Feb. 18, 2010

(30) Foreign Application Priority Data

Apr. 23, 2007 (JP) ..... 2007-113260
Sep. 28, 2007 (JP) ..... 2007-255094

(51) Int. Cl.
*B25B 23/18* (2006.01)

(52) U.S. Cl. ..... 173/176; 173/217; 173/171; 362/119; 362/120; 362/395; 362/578

(58) Field of Classification Search ..... 173/2, 176, 173/178, 217, 171; 362/119, 120, 394, 395, 362/206, 578, 572, 577
See application file for complete search history.

(56) References Cited

U.S. PATENT DOCUMENTS

| | | | | |
|---|---|---|---|---|
| 4,078,869 | A * | 3/1978 | Honeycutt | 408/16 |
| 5,525,842 | A * | 6/1996 | Leininger | 290/54 |
| 6,033,082 | A * | 3/2000 | Lin | 362/120 |
| 6,095,659 | A * | 8/2000 | Hsu | 362/119 |
| 7,080,964 | B2 * | 7/2006 | Riley et al. | 408/16 |
| 7,278,751 | B2 * | 10/2007 | Chang et al. | 362/120 |
| 7,540,334 | B2 * | 6/2009 | Gass et al. | 173/2 |
| 7,815,356 | B2 * | 10/2010 | Lutz et al. | 362/577 |
| 7,866,839 | B2 * | 1/2011 | Chien | 362/119 |
| 2005/0157492 | A1 * | 7/2005 | Chiu | 362/184 |
| 2006/0104085 | A1 * | 5/2006 | Walker et al. | 362/578 |
| 2006/0262519 | A1 * | 11/2006 | Hirschburger et al. | 362/119 |

FOREIGN PATENT DOCUMENTS

| | | |
|---|---|---|
| EP | 1 658 932 A1 | 5/2006 |
| JP | 8-252778 A | 10/1996 |

* cited by examiner

*Primary Examiner* — Scott A. Smith
(74) *Attorney, Agent, or Firm* — Kilpatrick Townsend & Stockton LLP

(57) ABSTRACT

An electrical power tool includes a housing, an electrical motor, an end-bit holding section, a transmitting mechanism, a cap, and a lighting section. The housing has one end. The electrical motor is accommodated in the housing and is configured to generate a rotational driving force. The end-bit holding section is provided at the one end and is rotatable about a rotational axis. The transmitting mechanism transmits the rotational driving force to the end-bit holding section. The cap is attached to the one end. The lighting section allows an entirety of the cap to be luminous.

9 Claims, 7 Drawing Sheets

ELECTRICAL POWER TOOL

TECHNICAL FIELD

The present invention relates to an electrical power tool and more specifically, to an electrical power tool having light for illuminating a work area.

BACKGROUND ART

A hand-held type electrical power tool such as a driver drill is conventionally known. Such a power tool includes a housing accommodating an electrical motor that generates a rotational driving force. The rotational driving force is transmitted to an end-bit holding section to rotate the end-bit holding section and an end bit such as a driver bit mounted on the end-bit holding section, thereby performing a desired work such as screw driving.

When performing the desired work using such a power tool in dark places such as attic and under-floor spaces where natural light does not reach, it is difficult to accurately perform the desired work such as screw driving due to darkness.

Japanese Patent Application Publication No. 2003-211374 discloses an electrical power tool including a light attached to a housing of the power tool, so that the light illuminates a work area, that is, an end bit and a screw or the like, in a spotlighting manner.

Japanese Patent Application Publication No. 2003-301669 discloses an electrical power tool including an LED lamp provided to a front lower surface of a main housing. Part of light emitted from the LED lamp is transmitted though an optical fiber to a display window provided to a front upper surface of the main housing, thereby illuminating the display window.

DISCLOSURE OF THE INVENTION

However, the conventional electrical power tool disclosed in Japanese Patent Application Publication No. 2003-211374 illuminates only the work area in a spotlighting manner. Thus, the power tool cannot illuminate a wide range including the work area, and also tends to generate shadows that can prevent efficient work.

The other conventional electrical power tool disclosed in Japanese Patent Application Publication No. 2003-301669 is configured to transmit part of light emitted from the LED lamp. Hence, sufficient illumination may not necessarily be provided to the display window. In addition, arrangement of the optical fiber in the main housing is not easy.

In view of the foregoing, it is an object of the present invention to provide an electrical power tool that is capable of illuminating a wide range including a work area and capable of preventing shadows from being generated, thereby improving workability at dark places.

This and other object of the present invention will be attained by an electrical power tool including a housing, an electrical motor, an end-bit holding section, a transmitting mechanism, a cap, and a lighting section. The housing has one end. The electrical motor is accommodated in the housing and is configured to generate a rotational driving force. The end-bit holding section is provided at the one end and is rotatable about a rotational axis. The transmitting mechanism transmits the rotational driving force to the end-bit holding section. The cap is attached to the one end. The lighting section allows an entirety of the cap to be luminous. With this arrangement, since the entirety of the cap is luminous, a broad range of work area can be illuminated and shadows are not generated. Hence, workability at dark places can be improved.

Preferably, the lighting section includes a light source and a light scattering section. The light source emits light. The light scattering section is configured to scatter the light emitted from the light source in different directions, allowing the entirety of the cap to be luminous. With this arrangement, the entirety of the cap can be luminous with a simple construction.

Preferably, the cap has a hollow cylindrical shape and is configured by transparent or translucent resin, and the light source and the light scattering section are disposed inside of the cap. With this arrangement, the light source and the light scattering section are not exposed to outside of the cap. Hence, the light source and the light scattering section neither impair exterior appearance of the electrical power tool, nor hinder user's work.

Preferably, the light scattering section includes a prism having a hollow cylindrical shape. With this arrangement, since the prism scatters light emitted from the light source in various directions, the entirety of the cap can be uniformly luminous.

Preferably, the cap has an inner circumferential surface formed with concavities and convexities. With this arrangement, since the light emitted from the light source is scattered by the concavities and convexities formed on the inner circumferential surface, the entirety of the cap can be uniformly luminous.

Preferably, the light source includes a light emitting diode. With this arrangement, since the light emitting diode emitting high-intensity light with small power consumption is employed as the light source, necessary and sufficient brightness can be obtained and power consumption can be saved to extend a life of a battery.

Preferably, the electrical power tool further includes a torque adjusting mechanism accommodated in the housing and configured to adjust a maximum torque transmitted to the end-bit holding section. The cap is rotatable about the rotational axis and serves as a torque adjusting dial for adjusting the maximum torque. The torque adjusting dial is configured by transparent or translucent resin. With this arrangement, the entirety of the torque adjusting dial becomes luminous. Hence, the torque adjusting dial can be seen at dark places. Thus, torque adjustments can be achieved easily and accurately at dark places with a simple construction.

Preferably, the torque adjusting dial has a hollow cylindrical shape having an outer circumferential surface, and numbers indicative of torque setting values are displayed on the outer circumferential surface. With this arrangement, the user can clearly see the torque setting values displayed on the outer circumferential surface of the torque adjusting dial, even at dark places. Thus, torque adjustments can be achieved even more easily and accurately at dark places.

Preferably, the outer circumferential surface includes a display portion and a transparent portion. The numbers are displayed on the display portion. The display portion is non-transparent. The transparent portion is capable of transmitting light. With this arrangement, since the numbers indicative of torque setting values are displayed on the non-transparent display portion and sufficient brightness is provided by the transparent portion, the numbers can be seen clearly even at dark places and thus torque adjustments can be achieved easily and accurately.

Preferably, the light source includes a light emitting diode. With this arrangement, since the light emitting diode emitting high-intensity light with small power consumption is employed as the light source, necessary and sufficient brightness can be obtained and the torque adjusting dial can be seen clearly with small power consumption.

BRIEF DESCRIPTION OF REFERENCE NUMERALS

Figure 1:
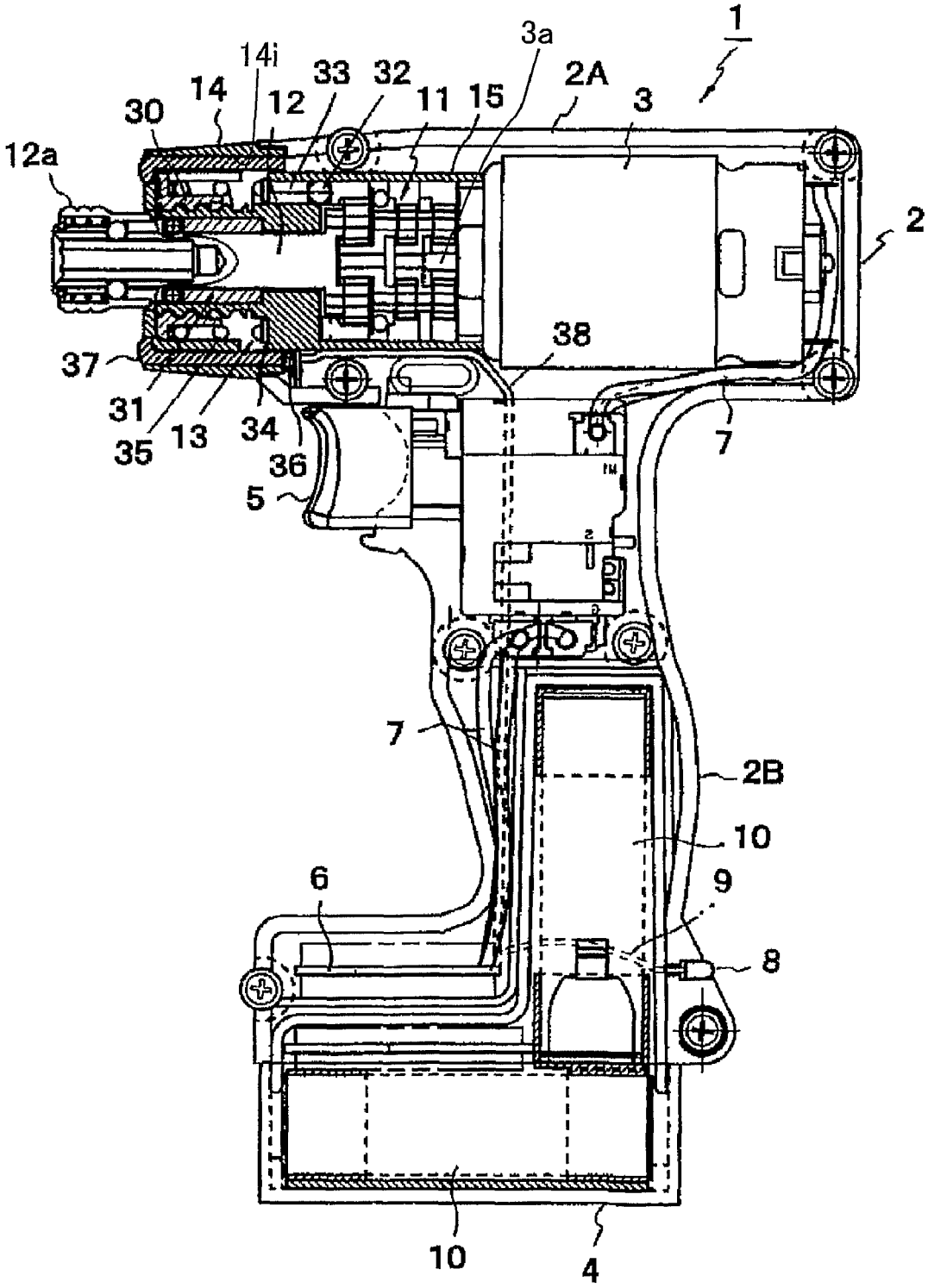
FIG. 1 is a cross-sectional view showing a driver drill according to a first embodiment of the present invention, wherein a pressing member is positioned at a front side such that a maximum torque is set to a low value.

1, 101 Driver drill (electrical power tool)
2, 102 Housing
2A, 102A Main body section of housing
2B, 102B Handle section of housing
3, 103 Electrical motor
3*a*, 103*a* Output shaft of electrical motor
4 Battery
5, 105 Switch
6 Control board
7, 9, 38, 138 Lead wire
8 Indicator lamp
10 Lithium ion batteries
11, 111 Planetary gear mechanism
12, 112 Output shaft
12*a*, 112*a* End-bit holding section of output shaft
13, 113 Torque adjusting mechanism
14 Cap
14*i* Inner circumferential surface of cap
15, 115 Gear case
15*a*, 115*a* Cylindrical part of gear case
16 Pinion gear
17, 22, 27 Ring gear
18, 23, 28 Planetary gears
19, 24, 29 Shaft
20, 25 Carrier
21, 26 Sun gear
27*a* Engaging claws of ring gear
30, 130 Pressing member
31 Bearing
32, 132 Ball
33 Spacer
34 Clutch plate
35, 135 Coil spring
36, 136 LED (light source)
37 Prism
114 Torque adjusting dial
114*a* Display portion
114*b* Transparent portion
140 Driver bit

BEST MODE FOR CARRYING OUT THE INVENTION

Figure 2:
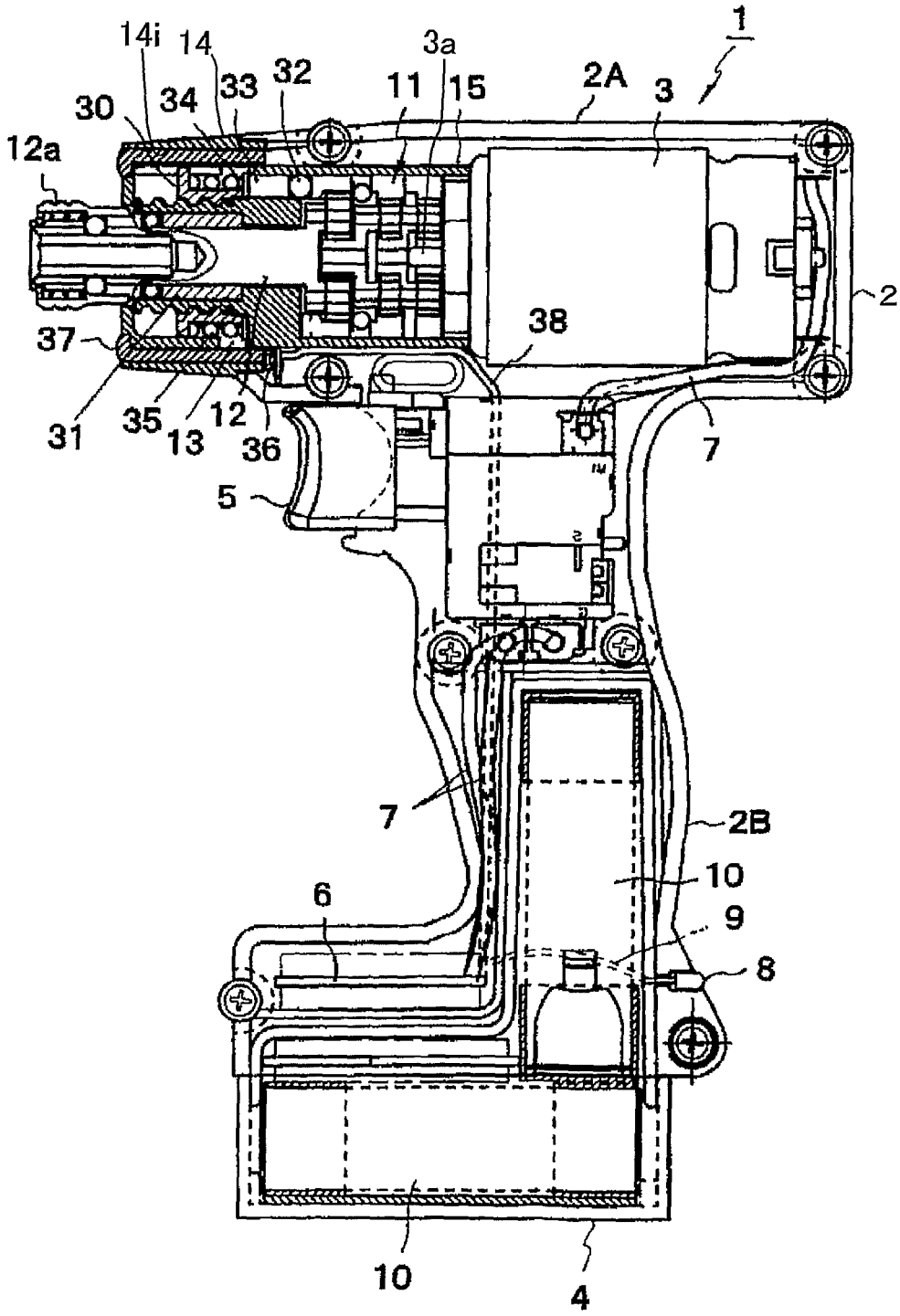
FIG. 2 is a cross-sectional view showing the driver drill according to the first embodiment, wherein the pressing member is positioned at a rear side such that the maximum torque is set to a high value.
Figure 3:
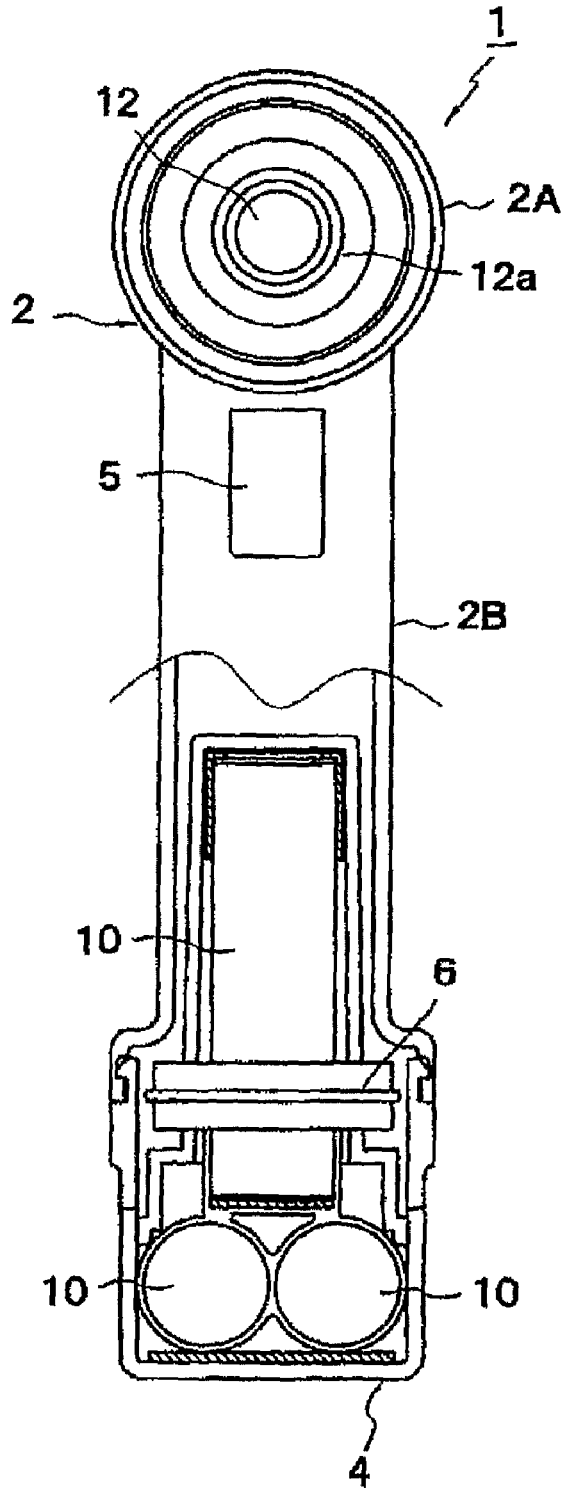
FIG. 3 is a front view with a partial cross section showing the driver drill according to the first embodiment.

An electrical power tool according to a first embodiment of the present invention will be described while referring to FIGS. 1 through 6. The electrical power tool of the first embodiment is applied to a driver drill 1. In FIGS. 1 and 2, the left side will be described as the front side of the driver drill 1 and the right side will be described as the rear side of the driver drill 1.

The driver drill 1 of the first embodiment includes a housing 2 formed of resin and having substantially a T-shape in a side view. The housing 2 includes a main body section 2A extending in the front-rear direction, and a handle section 2B extending downward from the main body section 2A and formed as an integral part with the main body section 2A. A lower part of the handle section 2B is formed with a space for accommodating a control board 6 described later.

An electrical motor 3 generating a driving force and having an output shaft 3*a* is accommodated in the main body section 2A such that the output shaft 3*a* extends in the front-rear direction. A battery 4 is detachably mounted to a lower end of the handle section 2B. The battery 4 includes three lithium ion batteries 10 therein. A switch 5 is provided at an upper end of the handle section 2B. The switch 5 is for turning ON and OFF the power supplied from the battery 4 to the electrical motor 3 for starting and stopping the electrical motor 3.

The control board 6 is accommodated in the space in the lower part of the handle section 2B. A lead wire 7 extending from the control board 6 is connected to the electrical motor 3 via the switch 5. An indicator lamp 8 configured by LED (light emitting diode) is embedded in a rear lower surface of the handle section 2B. The indicator lamp 8 is connected to the control board 6 via a lead wire 9. The indicator lamp 8 is for emitting light in different colors depending on a remaining amount of the battery 4 and on torque.

A hollow-cylindrical gear case 15 is disposed in the main body section 2A for accommodating a planetary gear mechanism 11 to be described later. An output shaft 12 is disposed to engage the planetary gear mechanism 11. A front part of the output shaft 12 serves as an end-bit holding section 12*a*. The planetary gear mechanism 11 decelerates rotation of the output shaft 3*a* and transmits the decelerated rotation to the output shaft 12 for rotatably driving the end-bit holding section 12*a* at predetermined speed and torque.

The driver drill 1 further includes a torque adjusting mechanism 13. The torque adjusting mechanism 13 is covered by a hollow cylindrical cap 14 that is rotatably mounted on a front end of the main body section 2A. Rotation of the cap 14 enables adjustments of a maximum torque that can be transmitted from the electrical motor 3 to the output shaft 12. The cap 14 is configured by transparent or translucent resin. The cap 14 has an inner circumferential surface 14*i*. The cap 14 is formed with a spline groove 14*g* for engaging a pressing member 30 as described later. A prism 37 (described later) is fixed to the cap 14.

Figure 4:
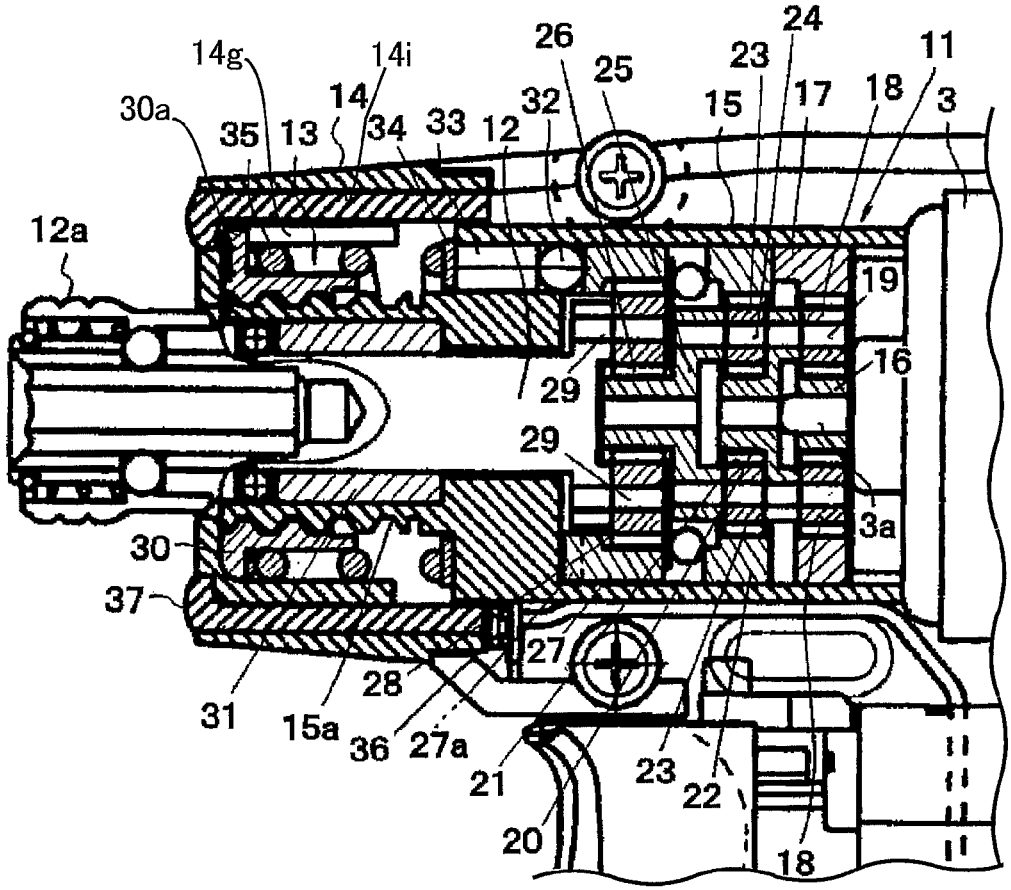
FIG. 4 is an enlarged partial cross-sectional view of the driver drill according to the first embodiment, for particularly showing a driving force transmitting mechanism.

A driving force transmitting mechanism including the planetary gear mechanism 11 and the torque adjusting mechanism 13 will be described in greater detail while referring to FIG. 4.

The planetary gear mechanism 11 has a three-stage deceleration mechanism. A first stage deceleration mechanism includes a pinion gear 16, a ring gear 17, a plurality of planetary gears 18, a plurality of shafts 19, and a carrier 20. The pinion gear 16 is integrally provided at the output shaft 3*a* of the electrical motor 3. The ring gear 17 is fixed to an inner circumference of the gear case 15. Each of the plurality of planetary gears 18 is engaged with both the pinion gear 16 and the ring gear 17. The plurality of planetary gears 18 is linked with the carrier 20 via respective ones of the plurality of shafts 19. Each of the plurality of planetary gears 18 circularly moves around the pinion gear 16 while rotating about the shaft 19. The circular movement of the plurality of planetary gears 18 rotates the carrier 20.

A second stage deceleration mechanism includes a sun gear 21, a ring gear 22, a plurality of planetary gears 23, a plurality of shafts 24, and a carrier 25. The sun gear 21 is integrally provided at the carrier 20. The ring gear 22 is fixed to the inner circumference of the gear case 15. Each of the plurality of planetary gears 23 is engaged with both the sun gear 21 and the ring gear 22. The plurality of planetary gears 23 is linked with the carrier 25 via respective ones of the plurality of shafts 24. Each of the plurality of planetary gears 23 circularly moves around the sun gear 21 while rotating about the shaft 24. The circular movement of the plurality of planetary gears 23 rotates the carrier 25.

A third stage deceleration mechanism includes a sun gear 26, a ring gear 27, a plurality of planetary gears 28, a plurality of shafts 29, and the output shaft 12. The sun gear 26 is integrally provided at the carrier 25. The ring gear 27 is supported by the inner circumference of the gear case 15 so as to be selectively rotatable and non-rotatable, as described later. Each of the plurality of planetary gears 28 is engaged with both the sun gear 26 and the ring gear 27. The plurality of planetary gears 28 is linked with the output shaft 12 via respective ones of the plurality of shafts 29. When the ring gear 27 is fixed and non-rotatable, each of the plurality of planetary gears 28 circularly moves around the sun gear 26 while rotating about the shaft 29, thereby rotating the output shaft 12. When the ring gear 27 is rotatable, each of the plurality of planetary gears 28 merely rotates about the shaft 29 and does not circularly move around the sun gear 26, thereby not transmitting rotation to the output shaft 12.

Next, the torque adjusting mechanism 13 will be described. A front part of the gear case 15 serves as a cylindrical part 15*a*. The cylindrical part 15*a* has a smaller diameter than the other part of the gear case 15, and its outer circumference is formed with screw thread. The pressing member 30 is threadingly engaged with the outer circumference of the cylindrical part 15*a*, so that the pressing member 30 can move in an axial direction (front-rear direction) while being rotated. The pressing member 30 has a radially extending part 30*a* that extends in a radial direction of the output shaft 12. The pressing member 30 is spline-fitted with the inner circumference of the cap 14 (the radially extending part 30*a* is engaged with the spline groove 14*g*), so that the pressing member 30 rotates together with the cap 14 and that the pressing member 30 is movable in the axial direction with respect to the cap 14. A bearing 31 is held by the cylindrical part 15*a* for rotatably supporting the output shaft 12.

The ring gear 27 has a front end surface that is provided with a plurality of engaging claws 27*a*. Although only one of the engaging claws 27*a* is shown in FIG. 4, the plurality of engaging claws 27*a* is provided with predetermined intervals in the circumferential direction. Each engaging claw 27*a* protrudes in the axial direction (toward the front). A plurality of balls 32 is abuttable on the plurality of engaging claws 27*a*.

A plurality of spacers 33 is fitted in the gear case 15 so as to be movable in the axial direction. Although only one of the spacers 33 is shown in FIG. 4, the plurality of spacers 33 is provided in one-to-one correspondence with the plurality of balls 32. Each spacer 33 has one surface (rear surface) that abuts on the ball 32 and another surface (front surface) that abuts on a ring-shaped clutch plate 34. A coil spring 35 is disposed in a compressed state between the clutch plate 34 and the pressing member 30. Accordingly, the coil spring 35 urges the ball 32 toward the front end surface of the ring gear 27.

The driver drill 1 has a lighting section that enables an entirety of the cap 14 to be luminous. The lighting section includes an LED (light emitting diode) 36 serving as a light source and the prism 37 serving as a light scattering section. As mentioned above, the cap 14 is configured by transparent or translucent resin. The LED 36 and the prism 37 are disposed inside the cap 14.

Figure 5:
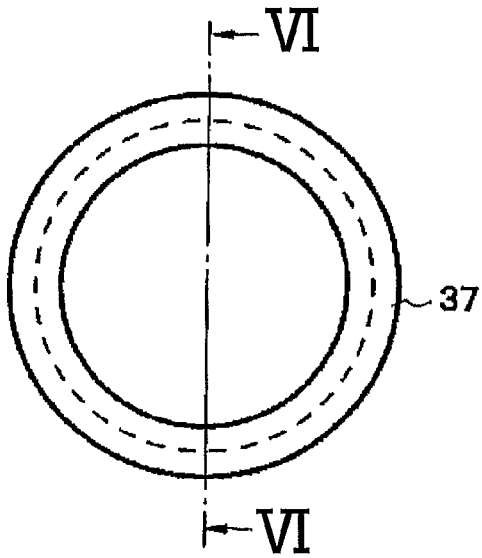
FIG. 5 is a front view showing a prism of the driver drill according to the first embodiment.
Figure 6:
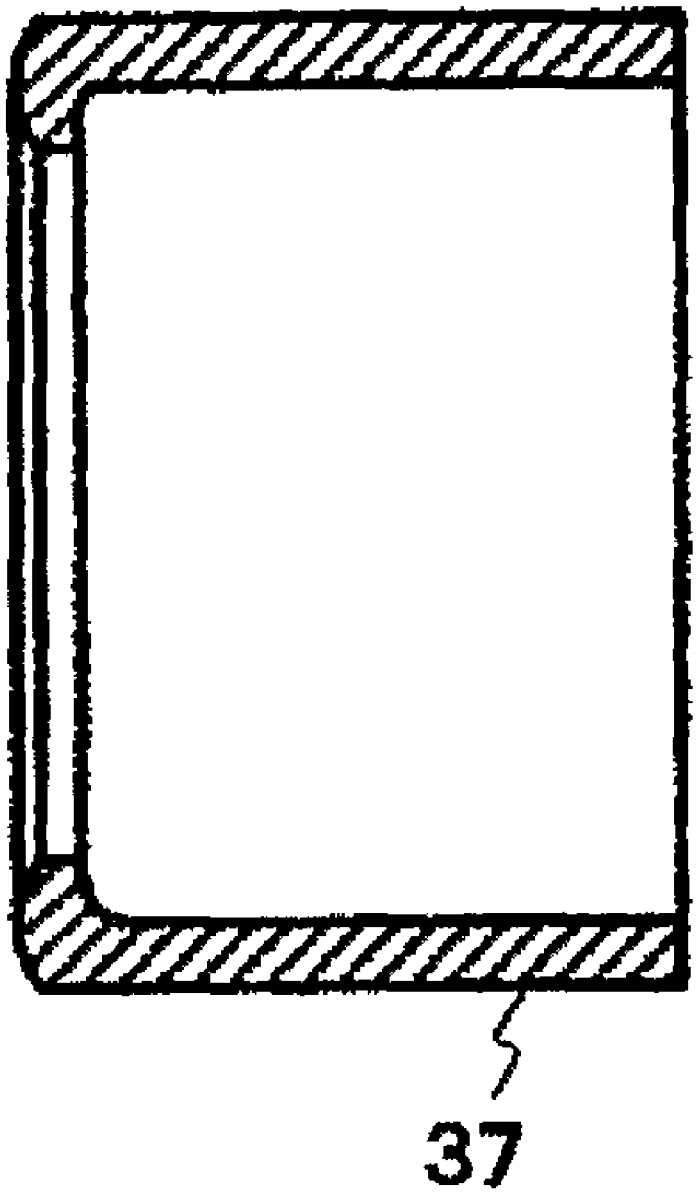
FIG. 6 is a cross-sectional view taken along a line VI-VI in FIG. 5.

The prism 37 is for scattering light emitted from the LED 36 over an entirety of the prism 37. As shown in FIGS. 5 and 6, the prism 37 is molded in substantially a hollow cylindrical shape by transparent resin. The LED 36 is disposed in confrontation with a lower part of a rear end surface of the prism 37. As shown in FIGS. 1 and 2, a lead wire 38 connects the LED 36 with the control board 6. The LED 36 is supplied with electric current from the battery 4 to emit high-intensity light. Then, the light is scattered by the prism 37 to the entire circumference (in all directions) to cause an entirety of the cap 14 to be uniformly luminous.

When performing screw driving operations using the above-described driver drill 1, a driver bit (not shown) is mounted on the end-bit holding section 12*a* of the output shaft 12. When a user turns the switch 5 to ON, electricity is supplied from the battery 4 to the electrical motor 3 for starting the electrical motor 3. Rotation of the output shaft 3*a* of the electrical motor 3 is decelerated in three stages by the planetary gear mechanism 11.

When a load torque applied to the output shaft 12 is smaller than a set value, the ring gear 27 of the planetary gear mechanism 11 is fixed by an urging force of the plurality of balls 32, preventing rotation of the ring gear 27. Hence, rotation from the output shaft 12 decelerated in three stages is transmitted to the output shaft 12, thereby rotating the driver bit (not shown) at a predetermined speed to drive a screw (not shown) into a workpiece (not shown).

In contrast, when the load torque applied to the output shaft 12 exceeds the set value, the engaging claws 27*a* of the ring gear 27 get over the balls 32. Thus, the ring gear 27 is released from a fixed state and starts rotation. At this time, each of the plurality of planetary gears 28 rotates about the shaft 29 but does not circularly move around the sun gear 26. Accordingly, rotation of the electrical motor 3 is not transmitted to the output shaft 12, so that an excessive load is neither applied to the planetary gear mechanism 11 nor the electrical motor 3. Hence, damages to these parts can be prevented.

The user can adjust a maximum torque that can be transmitted from the electrical motor 3 to the output shaft 12 as follows. By rotating the cap 14 to move the pressing member 30 in the axial direction along the cylindrical part 15*a*, the length of the coil spring 35 is changed and thus the urging force of the ball 32 toward the ring gear 27 is changed. As shown in FIG. 2, for example, when the pressing member 30 is moved to the rear side for compressing the coil spring 35, a reaction force of the coil spring 35 increases and the urging force of the ball 32 toward the ring gear 27 also increases. Thus, the maximum torque that can be transmitted from the electrical motor 3 to the output shaft 12 is set to a large value.

When performing work using the above-described driver drill 1 at dark places such as attic and under floor spaces, the high-intensity light emitted from the LED 36 is scattered by the prism 37 to various directions, allowing the entirety of the cap 14 to be uniformly luminous. Thus, a large area around the end-bit holding section 12*a*, the end bit, and the workpiece can be illuminated and, in addition, shadows are not formed. Hence, workability at dark places can be improved. Further, in the present embodiment, since the LED 36 emitting high-intensity light with small power consumption is employed as a light source, necessary and sufficient brightness can be obtained. Also, power consumption can be saved to extend a life of the battery 4.

Further, in the above-described embodiment, the LED 36 and the prism 37 constituting the lighting section are arranged inside the cap 14. Hence, the LED 36 and the prism 37 are not exposed to outside of the cap 14, preventing exterior appearance of the driver drill 1 from being impaired and also preventing the LED 36 and the prism 37 from hindering the user's work.

Figure 7:
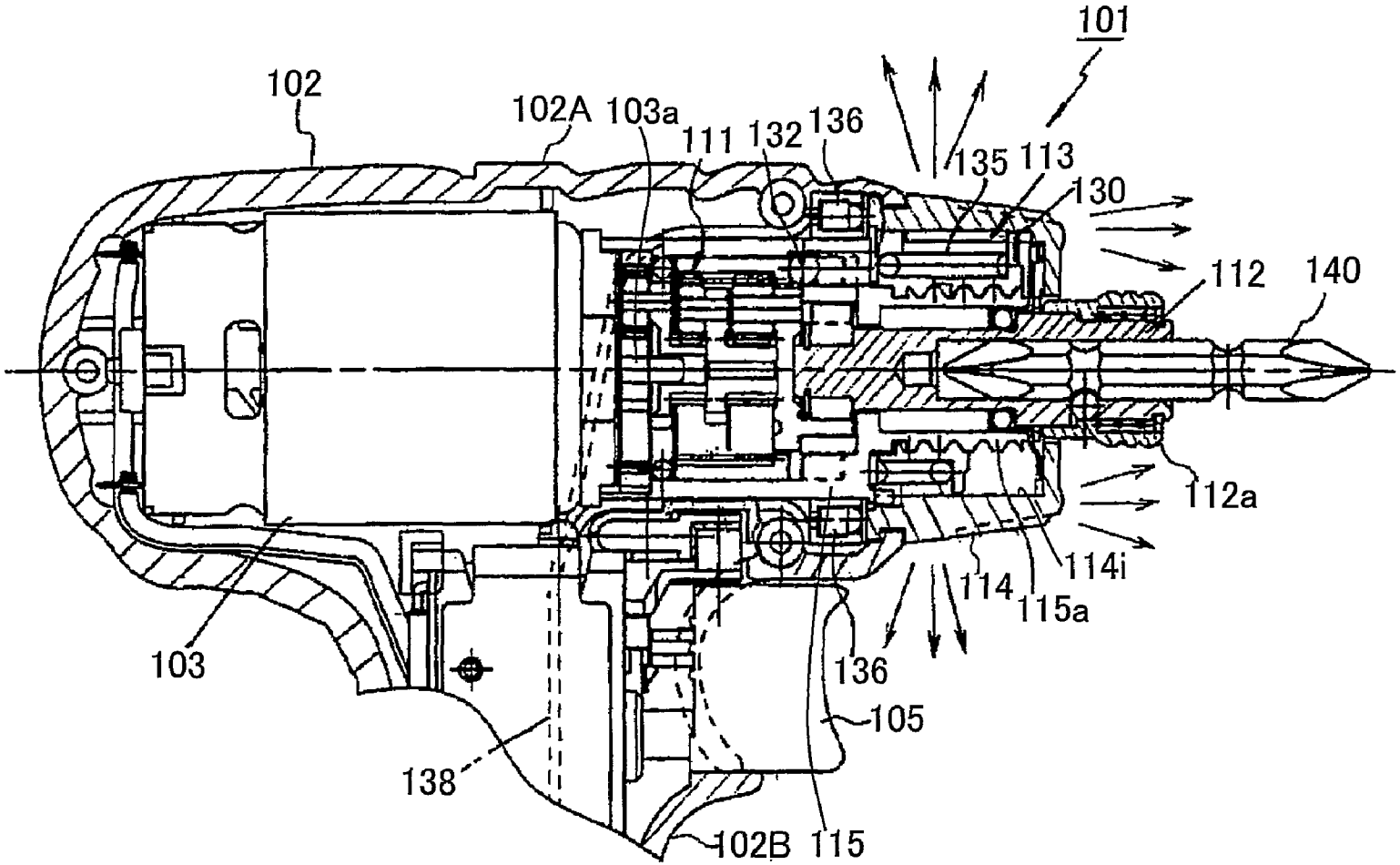
FIG. 7 is a partial cross-sectional view showing a driver drill according to a second embodiment of the present invention.
Figure 8:
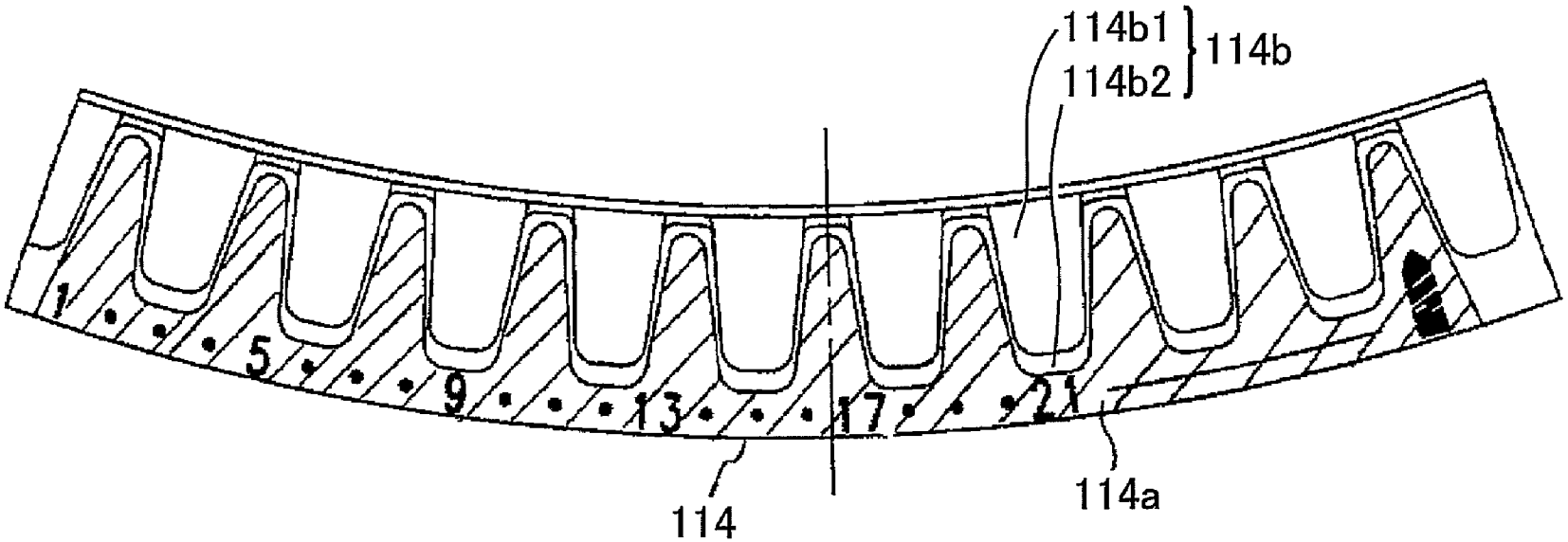
FIG. 8 is a development view showing a torque adjustment dial of the driver drill according to the second embodiment.

An electrical power tool according to a second embodiment of the present invention will be described while referring to FIGS. 7 and 8. The electrical power tool of the second embodiment is applied to a driver drill 101. In FIGS. 7 and 8, the left side will be described as the rear side of the driver drill 101 and the right side will be described as the front side of the driver drill 101. To each element of the second embodiment, the same reference numeral has been applied as the like element in the first embodiment, augmented by 100.

The driver drill 101 of the second embodiment includes a housing 102 having a main body section 102A and a handle section 102B. An electrical motor 103 having an output shaft 103*a* is accommodated in the main body section 102A. A switch 105 is provided at a front upper part of the handle section 102B. A battery (not shown) is detachably mounted to a lower end of the handle section 102B. A gear case 115 is provided in the main body section 102A. The gear case 115 has a cylindrical part (screw member) 115*a*. A planetary gear mechanism 111 is accommodated in the gear case 115 for decelerating rotation of the output shaft 103*a* and for transmitting the rotation to an output shaft (spindle) 112. A driver bit 140 is mounted on a front end of the output shaft 112 via a chuck 112*a*. A torque adjusting mechanism 113 is provided for adjusting a maximum torque that can be transmitted to the driver bit 140.

A torque adjusting dial 114 is provided for adjusting the maximum torque in cooperation with the torque adjusting mechanism 113. The torque adjusting dial 114 has substantially a hollow cylindrical shape. The torque adjusting dial 114 has an inner circumferential surface 114*i*. A large number of concavities and convexities serving as a light scattering section are formed on the inner circumferential surface 114*i*. The torque adjusting dial 114 is rotatably provided to a front end of the main body section 102A.

The cylindrical part 115*a* has an outer circumferential surface formed with screw threads. A pressing member (screw receiving member) 130 is threadingly engaged with the outer circumferential surface of the cylindrical part 115*a*, so that the pressing member 130 can move in the front-rear direction. An outer circumference of the pressing member 130 is spline-fitted with an inner circumference of the torque adjusting dial 114. Hence, the pressing member 130 rotates together with the torque adjusting dial 114, while moving in the front-rear direction on the cylindrical part 115*a*. The other parts of the torque adjusting mechanism 113 are basically identical to the torque adjusting mechanism 13 of the first embodiment. Accordingly, a user can adjust a maximum torque that can be transmitted to the output shaft 112, by rotating the torque adjusting dial 114. Note that the upper half and the lower half of the torque adjusting mechanism 113 in FIG. 7 with respect to the rotational axis show different states of the driver drill 101. More specifically, in the upper half, the pressing member 130 is located at the front side so that a coil spring 135 is in a weakly compressed state. In the lower half, the pressing member 130 is located at the rear side so that the coil spring 135 is in a strongly compressed state.

As shown in FIG. 7, the driver drill 101 of the second embodiment includes two LEDs 136 that are arranged at a front end portion of the main body section 102A, the front end portion being coupled with a rear end of the torque adjusting dial 114. Here, one of the two LEDs 136 is arranged at a top portion of the front end portion, while the other one of the two LEDs 136 is arranged at a bottom portion of the front end portion. The two LEDs 136 are electrically connected with the battery (not shown) via a lead wire 138 and the switch 105. Reflection plates (not shown) are provided at rear sides of respective ones of the two LEDs 136. B0023,0009

The torque adjusting dial 114 will be described in greater detail while referring to FIG. 8. FIG. 8 is a development view showing the torque adjustment dial 114, drawn by developing views from directions perpendicular to the driver bit 140 around the torque adjusting dial 114. The upper side of FIG. 8 corresponds to the front side of the driver drill 101, while the lower side of FIG. 8 corresponds to the rear side of the driver drill 101. The torque adjusting dial 114 is made of transparent resin. As shown in FIG. 8, the torque adjusting dial 114 has an outer circumferential surface displaying numbers "1", "5", "9", and so on, indicative of values of set maximum torque (torque setting values). More specifically, the outer circumferential surface of the torque adjusting dial 114 includes a display portion 114*a* having a saw-tooth shape (hatched region in FIG. 8) and a transparent portion 114*b*. The display portion 114*a* is painted and opaque (non transparent). The numbers "1", "5", "9", and so on, indicative of the torque setting values are displayed on the display portion 114*a*. The user can easily perform torque adjustments by rotating the torque adjusting dial 114 while visually checking these numbers. The transparent portion 114*b* is a portion excluding the display portion 114*a* from the outer circumferential surface of the torque adjusting dial 114. The transparent portion 114*b* is transparent or translucent and is capable of transmitting light. Note that the transparent portion 114*b* includes a depressed portion 114*b*1 having inverted trapezoidal shapes and a sloped portion 114*b*2 having a meandering shape. The depressed portion 114*b*1 is depressed from the display portion 114*a*. The sloped portion 114*b*2 is a slope connecting the depressed portion 114*b*1 and the display portion 114*a*. Since irregularities are provided on the outer circumferential surface of the torque adjusting dial 114 in this way, the user can operate the torque adjusting dial 114 easily and accurately.

Accordingly, with the driver drill 101 in the second embodiment, when the user grips the handle section 102B and turns the switch 105 on, electrical power is supplied from the battery (not shown) to the electrical motor 103 for starting rotation of the electrical motor 103. Rotation of the electrical motor 103 is transmitted to the output shaft 112 and the driver bit 140 mounted on the output shaft 112. The electrical power is also supplied to the two LEDs 136 for turning the LED lights on. The LED lights emitted from the LEDs 136 illuminate an entirety of the torque adjusting dial 114. The torque setting values (numbers) are displayed on the non-transparent display portion 114*a* and sufficient brightness is provided by the transparent portion 114*b*. Hence, the user can clearly see the torque setting values (numbers) displayed on the outer circumferential surface of the torque adjusting dial 114, even at dark places such as attic and underfloor spaces where natural light does not reach. Thus, torque adjustments can be achieved easily and accurately at dark places with such a simple construction. In other words, the driver drill 101 can be set accurately to a desired torque. Further, since the reflection plates (not shown) are provided at the rear sides of the two LEDs 136 as described above, the lights emitted from the LEDs 136 do not leak toward the rear sides, allowing a greater portion of the lights is irradiated forward, that is, toward the torque adjusting dial 114.

While the invention has been described in detail with reference to the above aspects thereof, it would be apparent to those skilled in the art that various changes and modifications may be made therein without departing from the scope of the claims.

For example, in the above-described first embodiment, the driver drill 1 is provided with the prism 37 that scatters the light emitted from the LED 36 to various directions for allowing the entirety of the cap 14 to be uniformly luminous. However, a large number of concavities and convexities may be formed on the inner circumferential surface 14*i* of the cap 14, without providing the prism 37. With this arrangement, the light emitted from the LED 36 is scattered by the large number of concavities and convexities (diffused reflection), thereby allowing the entirety of the cap 14 to be uniformly luminous. Alternatively, a large number of concavities and convexities may be formed on the inner circumferential surface 14*i* of the cap 14, in addition to providing the prism 37. With this arrangement, the entirety of the cap 14 can be luminous even more uniformly.

In the first embodiment, the electrical power tool of the present invention is applied to the driver drill 1. However, the electrical power tool of the present invention can also be applied to an impact driver and other hand-held type electrical power tools.

Similarly, in the above-described second embodiment, the electrical power tool of the present invention is applied to the driver drill 101. However, the electrical power tool of the present invention can also be applied to other electrical power tools having a torque adjusting dial for adjusting torque by rotating the torque adjusting dial.

The invention claimed is:

1. An electrical power tool comprising:

a housing having one end;

an electrical motor accommodated in the housing and configured to generate a rotational driving force;

an end-bit holding section provided at the one end and rotatable about a rotational axis;

a transmitting mechanism that transmits the rotational driving force to the end-bit holding section;

a cap attached to the one end;

a lighting section that allows the cap to be luminous; and a torque adjusting mechanism accommodated in the housing and configured to adjust a maximum torque transmitted to the end-bit holding section, wherein the cap is rotatable about the rotational axis and serves as a torque adjusting dial for adjusting the maximum torque; and wherein the torque adjusting dial has a transparent or translucent resin part.

2. The electrical power tool as claimed in claim 1, wherein the lighting section comprises:

a light source that emits light; and a light scattering section that is configured to scatter the light emitted from the light source in different directions, allowing the entirety of the cap to be luminous.

3. The electrical power tool as claimed in claim 2, wherein the cap has a hollow cylindrical shape and is configured by transparent or translucent resin; and wherein the light source and the light scattering section are disposed inside of the cap.

4. The electrical power tool as claimed in claim 3, wherein the light scattering section comprises a prism having a hollow cylindrical shape.

5. The electrical power tool as claimed in claim 3, wherein the cap has an inner circumferential surface formed with concavities and convexities.

6. The electrical power tool as claimed in claim 2, wherein the light source comprises a light emitting diode.

7. The electrical power tool as claimed in claim 1, wherein the torque adjusting dial has a hollow cylindrical shape having an outer circumferential surface; and wherein numbers indicative of torque setting values are displayed on the outer circumferential surface.

8. The electrical power tool as claimed in claim 7, wherein the outer circumferential surface includes:

a display portion on which the numbers are displayed, the display portion being non-transparent; and a transparent portion capable of transmitting light.

9. The electrical power tool as claimed in claim 1, wherein the light source comprises a light emitting diode.

* * * * *